US005288746A

United States Patent [19]

Pramod

[11] Patent Number: 5,288,746

[45] Date of Patent: Feb. 22, 1994

[54] LIQUID LAUNDRY DETERGENTS CONTAINING STABILIZED GLUCOSE/GLUCOSE OXIDASE AS $H_2O_2$ GENERATION SYSTEM

[75] Inventor: Kakumanu Pramod, Cincinnati, Ohio

[73] Assignee: The Procter & Gamble Company, Cincinnati, Ohio

[21] Appl. No.: 992,326

[22] Filed: Dec. 21, 1992

[51] Int. Cl.[5] ..... C11D 3/395; C11D 3/386; C11D 3/26

[52] U.S. Cl. ..... 252/95; 252/174.12; 252/102; 252/DIG. 12; 252/DIG. 14; 435/189; 435/190

[58] Field of Search ..... 252/174.12, 95, DIG. 12, 252/DIG. 14, 102; 435/189, 190

[56] References Cited

U.S. PATENT DOCUMENTS

| | | | |
|---|---|---|---|
| 3,178,789 | 1/1993 | Estell | 252/174.12 |
| 3,640,877 | 2/1972 | Gobert et al. | 252/99 |
| 4,077,768 | 3/1978 | Johnstone | 8/107 |
| 4,421,668 | 12/1983 | Cox | 252/174.12 |
| 4,566,985 | 1/1986 | Bruno | 252/174.12 |
| 5,227,084 | 7/1993 | Martens et al. | 252/95 |

FOREIGN PATENT DOCUMENTS

| | | | |
|---|---|---|---|
| 0003149 | 7/1979 | European Pat. Off. . | |
| 0003371 | 8/1979 | European Pat. Off. . | |
| 0384503 | 8/1990 | European Pat. Off. | C11D 3/395 |
| 0458397A2 | 11/1991 | European Pat. Off. | C11D 3/395 |
| 0458398A2 | 11/1991 | European Pat. Off. | C11D 3/395 |
| 61-51099 | 3/1986 | Japan . | |
| 8909813 | 10/1989 | PCT Int'l Appl. . | |
| WO9105839 | 5/1991 | PCT Int'l Appl. . | |
| 692200 | 10/1970 | South Africa . | |
| 2101167 | 1/1983 | United Kingdom . | |
| 2150944A | 7/1985 | United Kingdom | C11D 3/60 |
| 2233653 | 1/1991 | United Kingdom . | |

OTHER PUBLICATIONS

Nakamura et al., J. of Biochem., "Mode of Inhibition of Glucose Oxidase by Metal Ions," 64:4, 839–47 (1968).

*Primary Examiner*—Paul Lieberman
*Assistant Examiner*—Kery A. Fries
*Attorney, Agent, or Firm*—Ronald L. Hemingway

[57] ABSTRACT

Liquid laundry detergent compositions containing glucose and glucose oxidase for generation of hydrogen peroxide during the laundering process are stabilized against premature hydrogen peroxide generation in the composition during storage by inclusion of $Cu^{2+}$ or $Ag^{+}$ ions in said compositions. The compositions also contain a bleaching catalyst to facilitate bleaching by the hydrogen peroxide.

10 Claims, No Drawings

LIQUID LAUNDRY DETERGENTS CONTAINING STABILIZED GLUCOSE/GLUCOSE OXIDASE AS $H_2O_2$ GENERATION SYSTEM

FIELD OF THE INVENTION

The invention relates to liquid laundry detergent compositions which contain glucose/glucose oxidaze as a system for generation of hydrogen peroxide when the composition is diluted for use. Premature generation of hydrogen peroxide during storage is prevented by inclusion of $Cu^{2+}$ or $Ag^{+}$ ions in the composition. The compositions also contain an oxidation catalyst to facilitate bleaching by the hydrogen peroxide.

BACKGROUND

The use of glucose/glucose oxidase in detergent compositions as a system for generation of hydrogen peroxide during use is disclosed in PCT Patent Application WO 91/05839, published May 2, 1991. The said compositions also contain a peroxidase enzyme which catalyzes the bleaching action of the hydrogen peroxide on dyes leached into the wash solution from colored fabrics, thereby preventing dye transfer among fabrics in the wash solution.

Nakamura et al., J. Biochem., 64:4, 439–47 (1968) discloses that the glucose/glucose oxidase reaction in aqueous media in the presence of oxygen to produce hydrogen peroxide is markedly inhibited by the presence of $Cu^{2+}$, $Hg^{2+}$ or $Ag^{+}$ ions and that this inhibitory effect can be completely reversed by further dilution of the system with water. However, there appears to be no previous reported work indicating whether this effect can be observed in the presence of detergent ingredients (i.e., anionic surfactants, builders, chelants, etc.) which can be expected to compete with the glucose oxidase enzyme for binding of $Cu^{2+}$.

DETAILED DESCRIPTION OF THE INVENTION

In aqueous solutions, in the presence of oxygen, glucose plus glucose oxidase generates low levels of hydrogen peroxide. As the hydrogen peroxide is used up by reaction with other materials (e.g., in the bleaching of materials present in a clothes laundering solution) more hydrogen peroxide is generated from the glucose/glucose oxidase/oxygen reaction. This system is particularly useful to generate controlled levels of hydrogen peroxide for use with a bleaching catalyst (e.g., iron porphin) in the catalyzed bleaching of dyes leached from fabrics in a laundry solution, to prevent dye transfer among the fabrics.

In accordance with the present invention, it has been found that when concentrated liquid detergent compositions are formulated to contain glucose and glucose oxidase, the molecular oxygen present in the composition interacts with the glucose/glucose oxidase to produce hydrogen peroxide during storage of the composition. The exposure of glucose oxidase to hydrogen peroxide during prolonged storage inactivates the glucose oxidase, thereby rendering the glucose/glucose oxidase system ineffective for sustained generation of additional hydrogen peroxide when the composition is subsequently diluted and used in the laundering of fabrics. In the practice of the present invention this premature generation of hydrogen peroxide during storage of the composition is prevented by including in the composition an amount of certain metal ions which is sufficient to inhibit the production of hydrogen peroxide in the composition, but which upon dilution of the composition, does not inhibit hydrogen peroxide production. Importantly, it was found that this inhibitor effect was not prevented in the presence of high levels of detergent ingredients which tend to complex said metal ions.

All percentages and ratios herein are by weight unless specified otherwise.

The compositions of the present invention are liquid detergent compositions which comprise:

A. from about 1% to about 60% of a detergent surfactant,

B. from about 0.1% to about 20% glucose,

C. from about 5 U to about 5000 U glucose oxidase per gram of the composition,

D. a water soluble source of a metal ion selected from the group consisting of $Cu^{2+}$ and $Ag^{+}$, or mixtures of said sources, in sufficient amount to provide, in the composition, from about 0.1 to about 100 ppm of said metal ion when the ion is $Ag^{+}$ and from about 20 to about 200 ppm when the ion is $Cu^{2+}$, E. an effective amount of a catalyst for hydrogen peroxide bleaching, and F. at least about 5% water.

DETERGENT SURFACTANT

The compositions of the present invention comprise from about 1% to about 60% of a detergent surfactant. The surfactant can be selected from anionics, nonionics, zwitterionics, amphoterics, cationics, and mixtures thereof. Typically, liquid detergent compositions for laundry use contain from about 5 to 30%, most preferably from about 10 to 25%, by weight of surfactant and the surfactant is typically selected from the group consisting of anionics, nonionics, and mixtures thereof.

Water-soluble salts of the higher fatty acids, i.e., "soaps," are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides to tallow or coconut oil; and the sodium and potassium alkylbenzene sulfonates in which the alkyl group contains from about 10 to about 16 carbon atoms, in straight chain or branched chain configuration, i.e., see U.S. Pat. Nos. 2,220,099 and 2,477,383. Especially valuable are linear straight chain alkylbenzene sulfonates in which the average number of carbon atoms in the alkyl group is from about 11 to 14, abbreviated $C_{11-14}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the instant compositions. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Other types of nonionic surfactants useful herein are polyhydroxy fatty acid amides of the formula

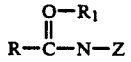

wherein R is $C_9$–$C_{17}$ alkyl or alkenyl, $R_1$ is methyl and Z is glycityl derived from a reduced sugar or alkoxylated derivative thereof. Examples are N-Methyl N-1-deoxyglucityl cocoamide and N-Methyl N-1-deoxyglucityl oleamide. Processes for making polyhydroxy fatty acid amides are known, e.g., see U.S. Pat. No. 2,965,576, Wilson, issued Dec. 20, 1960 and U.S. Pat. No. 2,703,798, Schwartz, issued Mar. 8, 1955.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Amphoteric surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms. See U.S. Pat. No. 3,929,678, Laughlin et al., issued Dec. 30, 1975.

Cationic surfactants can also be included in the present detergent compositions. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable balancing anions for such compounds. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr., et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Further disclosures of surfactants are set forth in U.S. Pat. No. 3,644,961, Norris, issued May 23, 1972; U.S. Pat. No. 3,929,678, Laughlin et al., issued Dec. 30, 1975; and U.S. Pat. No. 4,379,080, Murphy, issued Apr. 5, 1983, all incorporated in their entirety herein by reference.

GLUCOSE AND GLUCOSE OXIDASE

The compositions herein contain glucose and glucose oxidase enzyme. As is well known, when these two materials are present together in an aqueous system which contains molecular oxygen, the glucose oxidase catalyzes the oxidation of glucose to gluconic acid, with the formation of hydrogen peroxide.

The amount of glucose in the compositions herein will be in the range of from about 0.1% to about 20% (preferably from about 1% to 10%) of the composition, and the glucose oxidase will be from about 5U to about 5000U (preferably 25 to 500U) per gram of the composition. The symbol "U" stands for activity units of the enzyme. By standard definition one activity unit of glucose oxidase will oxidize 1.0μ mole of β-D-glucose to D-gluconic acid and hydrogen peroxide per minute at pH 5.1° at 35° C.

GLUCOSE/GLUCOSE OXIDASE REACTION INHIBITOR

As a practical matter it is not possible to prepare liquid detergent compositions containing glucose and glucose oxidase which are free of molecular oxygen. Molecular oxygen is inherently present in the water and may also be present in other ingredients used to formulate the composition. Typically, there will be at least about 0.1 ppm molecular oxygen in the compositions. Consequently, the glucose/glucose oxidase/oxygen reaction to generate hydrogen peroxide will occur during storage of the composition, and this extended exposure of glucose oxidase to hydrogen peroxide eventually leads to inactivation of the glucose oxidase. In accordance with the present invention, certain metal ions which inhibit the reaction, i.e., $Cu^{2+}$ or $Ag^{+}$ are incorporated into the composition in amounts which inhibit the formation of hydrogen peroxide in the composition, but which are ineffective to inhibit the reaction of the glucose/glucose oxidase/oxygen when the composition is diluted for use. The reaction-inhibiting ions can be used singly or in combination in the compositions herein. Suitable sources of such ions are their water-soluble salts, e.g., cupric sulfate, cupric nitrate, cupric chloride, cupric acetate, silver acetate, silver nitrate, and silver fluoride. The preferred ion is $Cu^{2+}$. The concentration of reaction-inhibiting ion in the compositions herein should be from about 20 to about 200 ppm (preferably 50–100 ppm) when the catalyst is $Cu^{2+}$ and from about 0.1 to 100 ppm (preferably 0.5 to 5 ppm) catalyst is $Ag^{+}$. $Ag^{+}$ and $Cu^{2+}$ can be used in combination with each other.

BLEACHING CATALYST

The compositions herein contain a bleaching catalyst which is capable of catalyzing the bleaching activity of hydrogen peroxide in aqueous media. Examples of such catalysts are peroxidases (e.g., horseradish peroxidase and coprinus peroxidase), metallo porphins and their water-soluble and water-dispersible derivatives, metallo porphyrins and their water-soluble and water-dispersible derivatives, metallophthalocyanines and haemin chloride. Such catalysts are described in U.S. Pat. No. 4,077,768 Johnston et al., issued Mar. 7, 1978, and incorporated by reference herein.

The metallo porphin structure may be visualized as indicated in Formula I below. In Formula I the atom positions of the porphin structure are numbered conventionally and the double bonds are put in conventionally. In the other numbered formulas (II–IV), the double bonds have been omitted in the drawing of the structure, but are actually present as in I.

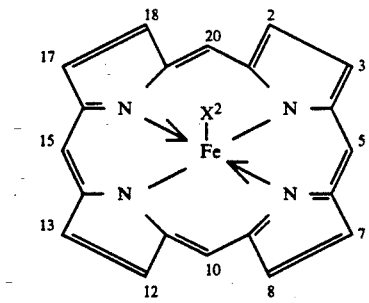

(I)

Preferred metallo porphin structures are those substituted at one or more of the 5, 10, 15 and 20 carbon positions of Formula I (meso positions), with a phenyl or pyridyl substituent selected from the group consisting of

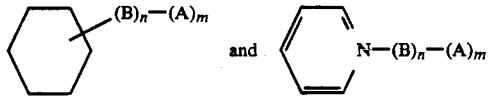

wherein n and m may be 0 or 1; A may be sulfate, sulfonate, phosphate or carboxylate groups; and B is $C_1$–$C_{10}$ alkyl, polyethoxy alkyl or hydroxy alkyl.

Preferred molecules are those in which the substituents on the phenyl or pyridyl groups are selected from the group consisting of $—CH_3$, $—C_2H_5$, $—CH_2CH_2CH_2SO_3—$, $—CH_2—$, and $—CH_2CH(OH)CH_2SO_3—$, $—SO_3—$ A particularly preferred metallo porphin is one in which the molecule is substituted at the 5, 10, 15, and 20 carbon positions with the substituent

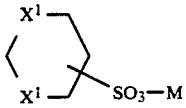

This preferred compound is known as metallo tetrasulfonated tetraphenylporphin. The symbol $X^1$ is (—CY—) wherein each Y, independently, is hydrogen, chlorine, bromine or meso substituted alkyl, cycloalkyl, aralkyl, aryl, alkaryl or heteroaryl. M is hydrogen or a neutralizing metal ion, preferably sodium.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

Porphin derivatives also include chlorophyls, chlorines, i.e., isobacterio chlorines and bacteriochlorines.

Metallo porphyrin and water-soluble or water-dispersible derivatives thereof have a structure given in Formula II.

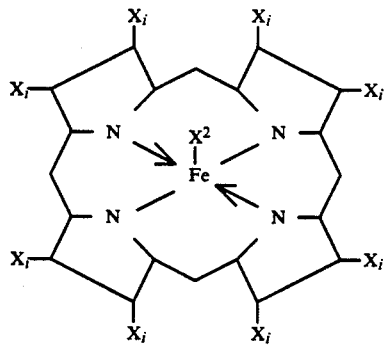

where The symbol $X_i$ can be alkyl, alkylcarboxy, alkylhydroxyl, vinyl, alkenyl, alkylsulfate, alkylsulfonate, sulfate, sulfonate.

The symbol $X^2$ of Formula II represents an anion, preferably $OH^-$ or $Cl^-$.

Metallo phthalocyanine and derivatives have the structure indicated in Formula III, wherein the atom positions of the phthalocyanine structure are numbered conventionally.

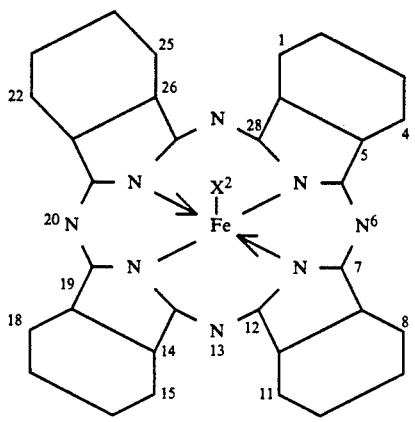

Preferred phthalocyanine derivatives are sulfonated metallo phthalocyanines, e.g., the trisulfonate and tetrasulfonate.

Haemin chloride has the structure given in Formula IV. Suitable derivatives include compounds wherein the propionic acid groups are ethoxylated.

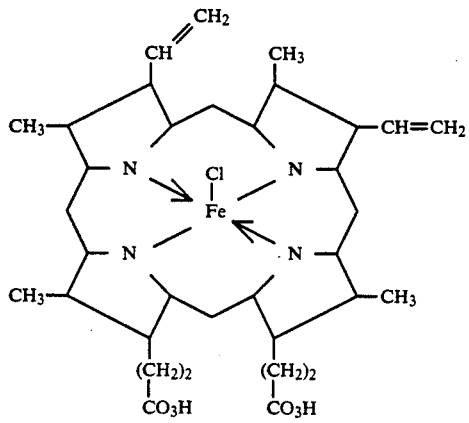

In the above described metallo compounds, the iron can be substituted by Mn, Co, Rh, Cr, Ru, Mo or other transition metals.

The anionic groups in any of the above structures preferably contain cations selected from the group consisting of sodium and potassium cations or other non-interfering cations which leave the structures water-soluble.

A number of considerations are significant in selecting variants of, or substituents in, the organometallic catalysts discussed above. In the first place, one would choose compounds which are available or can be readily synthesized.

Beyond this, the choice of the substituent groups can be used to control the solubility of the catalyst in water or in detergent solutions. Yet again, especially where it is desired to avoid attacking dyes attached to solid surfaces (as opposed to dyes in solution), the substituents can control the affinity of the catalyst compound for the surface. Thus, strongly negatively charged substituted compounds, for instance the tetrasulfonated porphin, may be repelled by negatively charged stains or stained surfaces and are therefore most likely not to cause attack on fixed dyes, whereas cationic or zwitterionic compounds may be attracted to, or at least not repelled by such stained surfaces.

When the bleaching catalyst is a metalloporphin metalloporphyrin, metallophthalocyanine or haemin the amount in the composition should be from about 50 ppm to about 10,000 ppm, preferably from about 500 ppm to about 2500 ppm. When the bleaching catalyst is peroxidase the amount should be from about 50 to 5000U per gm (preferably about 100 to 2500U per gm) of the composition.

OPTIONAL INGREDIENTS

The compositions herein can also contain a variety of other components which are useful in the employment of the compositions herein.

In addition to water, which typically comprises from about 5% to 80% of the compositions, the liquid medium of the compositions can comprise other liquid materials such as solvents and hydrotopes, e.g., ethanol, propylene glycol, glycerin, ethylaneglycol monobutyl ether, etc.

Inorganic detergency builders useful in the compositions herein include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates (i.e., zeolites). Borate builders, as well as builders containing borate-forming materials that can produce borate under detergent storage or wash conditions (hereinafter, collectively "borate builders"), can also be used. Preferably, non-borate builders are used in the compositions of the invention intended for use at wash conditions less than about 50° C., especially less than about 40° C.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, incorporated herein by reference.

Organic detergency builders preferred for the purposes of the present invention include a wide variety of polycarboxylate compounds. As used herein, "polycarboxylate" refers to compounds having a plurality of carboxylate groups, preferably at least two carboxylates. For example, citric acid is a useful organic builder.

Polycarboxylate builders can generally be added to the composition in acid form, but can also be added in the form of a neutralized salt. When utilized in salt form, alkali metals, such as sodium, potassium, and lithium or alkanolammonium salts are preferred.

Included among the polycarboxylate builders are a variety of categories of useful materials. One important category of polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1965 and Lamberti et al., U.S. Pat. No. 3,635,830, issued Jan. 18, 1972, both of which are incorporated herein by reference.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Detergency builders are useful for precipitating or chelating hardness ions (i.e., $Ca^{2+}$ and $Mg^{2+}$) in water used in formulating the compositions herein and in wash solutions made with the compositions. Typically, builders are used at levels of from about 1% to about 40%, preferably from about 5% to about 30% in the compositions herein.

Hydrotrope salts such as alkli metal cumene and xylene sulfonates can be used.

pH adjustment agents such as alkali metal hydroxides and alkanolamines (e.g., ethanolamine) and organic and inorganic acids can be used to adjust the compositions to the pH desired. Preferably, the composition should be formulated so as to produce a pH of from about 7 to about 8.5 when diluted for use in laundering.

Enzymes which attack soils and stains such as lipases, alkaline proteases and cellulases can be used, and enzyme stabilizers such as diethylaminoethanol can be used.

Soil release polymers such as block copolymers of ethylene terephthalate with polyethylene oxide or polypropylene oxide (see U.S. Pat. No. 3,959,230, Hayes, issued May 25, 1976 and incorporated by reference herein) can be used in the present compositions at levels of from about 0.1% to about 2%.

Materials which stabilize the bleaching catalyst, e.g., imidizole can be included in the compositions at levels of from about 0.005 to about 5%.

Materials which prevent deposition of organometallo bleaching catalysts onto fabrics can be used. These include polyvinylpyrrolidone, polyvinylalcohol and polyethylene glycol.

Phenolic compounds such as sodium salt of phenol sulfonate can be used to accelerate the rate of dye bleaching by the compositions herein.

Other optional ingredients which can be present in the compositions herein include soil dispersing agents such as polyacrylic acid and polyaspartic acid and their salts (e.g., sodium or potassium salts) and tetraethylenepentaamine ethoxylate (15–18 EO units). Optical brighteners, perfumes, and suds suppressants (e.g., fatty acids or silicones) can also be used.

The invention will be illustrated by the following non-limiting example:

EXAMPLE 1

Experiments to demonstrate the present invention were performed using an aqueous liquid laundry detergent having the following approximate composition:

| | |
|---|---|
| $NaC_{14-15}$ $(EO)_{2.5}$ sulfate* | 10.0 |
| $C_{12.3}$ linear alkyl benzene sulfonate | 10.0 |
| $C_{12-13}$ alkyl $(EO_{6.5})H$** | 2.3 |
| Citric Acid | 3.3 |
| $C_{12-14}$ fatty acid | 2.8 |
| Propylene glycol | 7.4 |
| Ethanol | 2.5 |
| Ca formate | 0.1 |
| Na formate | 1.0 |
| Tetraethylenepentamine ethoxylate | 1.2 |
| Perfume/color/misc. | 0.9 |
| Water | balance to 100 |

*ethoxylated alkyl sulfate
**alkyl ethoxylate

Experiment A

(Peroxidase Bleaching Enzyme)

A composition of the invention was prepared as follows: 15 grams of the liquid detergent were mixed with 0.75 g glucose, 750 U glucose oxidase, 3.75 mg $CuSO_4$ pentahydrate, 7500 U peroxidase oxidation catalyst, and 0.075 g phenolsulfonate bleaching accelerator. The composition thus contained 5% glucose, 50U glucose oxidase/gm, 64 ppm $Cu^{2+}$, 500U/gm peroxidase and 0.5% phenolsulfonate. The peroxidase was coprinus peroxidase obtained from NOVO Nordisk, Bagsvaerd, Denmark. An activity unit of this peroxidase is defined as the amount of the enzyme which will catalyze the oxidation of 2 $\mu$M of ABTS [2,2'-azinobis(3ethylbenzothiazoline-6-sulfonate] consuming 1 $\mu$M of $H_2O_2$ per minute at 30° C. and pH 7.

A comparable sample of the composition, without copper sulfate, was also prepared. These samples were stored at 80° F. in a constant temperature room. The stored samples were tested every week for 6 weeks for dye bleaching benefits in the wash solution. Dye bleaching was monitored by the following procedure:

0.4 g of the stored detergent was added to 200 ml of 20 ppm polar blue dye solution at 95° F. Dye bleaching was monitored by observing the visible absorption of the dye using spectrophotometer. Results were compared with the control (sample stored without copper sulphate). The results are expressed in percent dye bleaching activity vs. a solution of freshly prepared detergent composition of the invention.

The results in the table below demonstrate the benefit of $Cu^{2+}$ in a composition of the invention when peroxidase is the bleaching catalyst. In a similar test in which 100° F. storage was used, the $Cu^{2+}$ containing composition was substantially less effective in maintaining dye bleaching performance than was the case in 80° F. storage. This is believed to be due to poorer stability of the peroxidase bleaching catalyst at the higher temperature.

| Week | Dye Bleaching (% Activity) Control (without Cu++) | With Cu++ |
|---|---|---|
| 1 week | 9.3 | 98.4 |
| 2 weeks | 2.1 | 97.0 |
| 3 weeks | 0 | 90.7 |
| 4 weeks | 0 | 87.2 |
| 5 weeks | 0 | 82.9 |
| 6 weeks | 0 | 73.5 |

Experiment B

(Iron Tetraphenyl Porphin Sulfonate Bleaching Catalyst)

A composition of the invention was prepared as follows: 15 grams of the liquid detergent was mixed with 0.75 g glucose, 750 U glucose oxidase, 3.75 mg $CuSO_4$ pentahydrate and 0.019 g. sodium salt of iron tetraphenyl porphin sulfonate. The composition thus contained 5% glucose, 50 U/gm glucose oxidase, 64 ppm $Cu^{2+}$, 1260 ppm of the porphin catalyst. A comparable sample was prepared without copper sulfate. These samples were stored at 80° F. in a constant temperature room. The stored samples were tested after each week for 2 weeks for dye bleaching benefits in the wash solution. Dye bleaching was monitored by the following procedure:

0.4 g of the stored detergent was added to 200 ml of 20 ppm polar blue dye solution at 95° F. Dye bleaching was monitored by observing the visible absorption of the dye using spectrophotometer. Results were compared with the control (sample stored without copper sulphate). The results are expressed in percent dye bleaching activity vs. a solution of freshly prepared composition of the invention.

The results in the table below demonstrate the benefit of $Cu^{2+}$, in a composition of the invention when using an iron porphin derivative as the bleaching catalyst.

| Week | Dye Bleaching (% Activity) Control (without Cu++) | With Cu++ |
|---|---|---|
| 1 week | 7.3 | 97.4 |
| 2 weeks | 1.9 | 95.0 |

What is claimed is:

1. A concentrated liquid detergent composition useful for inhibiting dye transfer among fabrics laundered in a diluted solution thereof, said composition comprising:

a) from about 1% to about 60% of an organic surfactant;

b) from about 1% to about 40% detergent builder;

c) from about 0.1% to about 20% glucose;

d) from about 5 U to about 5000 U glucose oxidase per gram of composition;

e) a water soluble source of a metal ion selected from the group consisting of $Cu^{2+}$, $Ag^{+}$ and mixtures of said sources, in sufficient amount to provide in the composition from about 0:1 to about 100 ppm of said metal ion when the ion is $Ag^{+}$ and from about 20 to about 200 ppm when the ion is $Cu^{2+}$;

f) an effective amount of a bleaching catalyst capable of catalyzing the bleaching effect of hydrogen peroxide; and g) at least about 5% water.

2. The composition of claim 1 wherein the level of glucose is from about 1% to about 10%.

3. The composition of claim 2 wherein the level of glucose oxidase is from about 25 U to about 500 U per gram.

4. The composition of claim 3 wherein when the source of metal ion in component d) is a source of $Cu^{2+}$, said source is present in an amount sufficient to provide from about 50 to about 100 ppm $Cu^{2+}$.

5. The composition of claim 3 wherein when the source of metal ion in component d) is a source of $Ag^{+}$, said source is present in an amount sufficient to provide from about 0.5 to about 5 ppm $Ag^{+}$.

6. The composition of any of claims 1 through 5 wherein the bleaching catalyst, component e), is selected from the group consisting of:

peroxidase enzymes, metalloporphins and their water-soluble and water dispersible derivatives, metallo porphyrins and their water-soluble and water-dispersible derivatives, metallophthocyanine and its derivatives, and haemin.

7. The composition of claim 6 wherein the bleaching catalyst of component e) is a peroxidase enzyme.

8. The composition of claim 7 wherein the bleaching enzyme is coprinus peroxidase.

9. The composition of claim 6 wherein the bleaching catalyst is selected from the group consisting of:

metalloporphins and their water-soluble and water dispersible derivatives, metallo porphyrins and their water-soluble and water-dispersible derivatives, metallophthocyanine and its derivatives, and haemin.

10. The composition of claim 9 wherein the bleaching catalyst is iron tetraphenyl porphin sulfonate.

* * * * *